US008957333B2

(12) United States Patent
Chou

(10) Patent No.: US 8,957,333 B2
(45) Date of Patent: Feb. 17, 2015

(54) THIN KEYBOARD STRUCTURE

(71) Applicant: Zippy Technology Corp., New Taipei (TW)

(72) Inventor: Chin-Wen Chou, New Taipei (TW)

(73) Assignee: Zippy Technology Corp., New Taipei (TW)

( * ) Notice: Subject to any disclaimer, the term of this patent is extended or adjusted under 35 U.S.C. 154(b) by 155 days.

(21) Appl. No.: 13/857,007

(22) Filed: Apr. 4, 2013

(65) Prior Publication Data

US 2014/0299456 A1 Oct. 9, 2014

(51) Int. Cl.
*H01H 9/26* (2006.01)
*H01H 13/76* (2006.01)

(52) U.S. Cl.
CPC ..... *H01H 13/76* (2013.01)
USPC ..... 200/5 A

(58) Field of Classification Search
USPC ..... 200/5 A, 18, 17 R, 50.36, 520, 329, 341
See application file for complete search history.

(56) References Cited

U.S. PATENT DOCUMENTS 4,117,438 A * 9/1978 Kim et al. ..... 336/75
4,295,012 A * 10/1981 Keeler et al. ..... 200/5 B
4,316,066 A * 2/1982 Muller et al. ..... 200/462

FOREIGN PATENT DOCUMENTS

TW M445471 7/2001
TW I220213 8/2004
TW M346861 12/2008
TW M419973 1/2012
TW M426075 4/2012
TW M434979 8/2012

* cited by examiner

*Primary Examiner* — Edwin A. Leon

(74) *Attorney, Agent, or Firm* — Muncy, Geissler, Olds & Lowe, P.C.

(57) ABSTRACT

A thin keyboard structure includes a circuit board and a keycap assembly board located on the circuit board. The circuit board has a plurality of command portions to receive contact and generate command signals. The keycap assembly board has a frame with a plurality of press zones corresponding to the command portions. Each press zone has at least one press portion corresponding to one command portion and depressible to move towards the command portion. Each press zone also has a deformation portion centered on the press portion and coiled and extended continuously from the press portion towards the frame at a preset interval to provide deformation and return force for the press portion during movement towards the command portion. The press portion and deformation portion replace the driven mechanism used in the conventional keyboard, hence total thickness of the keyboard can be reduced to make the keyboard thinner.

19 Claims, 9 Drawing Sheets

THIN KEYBOARD STRUCTURE

FIELD OF THE INVENTION

The present invention relates to a keyboard and particularly to a thin keyboard.

BACKGROUND OF THE INVENTION

There are numerous types of input devices for computer systems, such as optical disk drivers, mouse, keyboards and the like. Among them keyboards are the most important. With constant advance of technology, the keyboards are increasingly being designed and made thinner, smaller and lighter. Conventional keyboards, such as those disclosed in Taiwan patent Nos. 445471, I220213 and M346861, generally have a keycap, a circuit board triggered by the keycap to generate a command signal, a baseboard located at one side of the circuit board and a driven mechanism with two ends connecting to the keycap and baseboard. The keycap is depressible to move towards the circuit board, and the driven mechanism is moved at the same time towards the circuit board to set on a circuit switch on the circuit board to generate a corresponding command signal. While the aforesaid keyboard structure can achieve the object of command input, the driven mechanism is formed at a certain thickness that becomes a constraint of keyboard and makes thinner keyboard impossible, hence cannot meet the prevailing requirement of lightness, thinness and slimness of the keyboard.

In order to overcome the aforesaid problem, some producers have proposed other keyboard designs, such as Taiwan patent Nos. M434979, M419973 and M426075, which change the form of the driven mechanism or propose other similar structure to replace the conventional driven mechanism. Although they can reduce the thickness of the keyboard to some degree, they still cannot fully meet most consumers' requirement in terms of thin keyboard. There are still rooms for improvement.

SUMMARY OF THE INVENTION

The primary object of the present invention is to provide a thin keyboard to conform to the prevailing trend of the keyboard that is light, thin and small.

To achieve the foregoing object, the invention provides a thin keyboard structure that includes a circuit board and a keycap assembly board located on the circuit board. The circuit board has a plurality of command portions to receive contact and generate command signals. The keycap assembly board has a frame with a plurality of press zones corresponding to the command portions. Each press zone has at least one press portion corresponding to one command portion and depressible to move towards the command portion. Each press zone also has a deformation portion centered on the press portion and coiled and extended continuously from the press portion towards the frame at a preset interval to provide deformation and return force for the press portion during movement towards the command portion.

In one aspect the keycap assembly board includes a plurality of keycaps corresponding to the press portions. Each keycap has a depressible press surface and a connection pin connecting to the press portion.

In another aspect the thin keyboard structure includes at least one elastic support portion located between the circuit board and frame to aid movement of the keycaps against the circuit board.

In yet another aspect the elastic support portion is sponge.

In yet another aspect the elastic support portion is conductive rubber.

In yet another aspect the elastic support portion is a dome-shaped reed.

In yet another aspect the thin keyboard structure includes a baseboard located beneath the circuit board and a light guide layer located between the circuit board and baseboard.

In yet another aspect the thin keyboard structure includes an optical mask layer located on the frame and having a plurality of light permeable openings corresponding to the command portions and an optical mask portion bonded to the frame.

In yet another aspect the keycap assembly board includes a support surface extended from the frame towards the press zone to connect to the deformation portion, and at least one support arm to bridge the support surface and deformation portion.

Furthermore, the invention provides another type of thin keyboard structure that includes a circuit board and a keycap assembly board located on the circuit board. The circuit board has a plurality of command portions to receive contact and generate command signals. The keycap assembly board has a frame with a plurality of press zones corresponding to the command portions. Each press zone has at least one press portion corresponding to one command portion and depressible to move towards the command portion. Each press zone also has at least one spacer centered about the press portion and spaced from the frame at a preset interval. The press portion and spacer are bridged by at least one first connection arm, and the spacer and frame are bridged by at least one second connection arm. The first connection arm has a first connecting section connected to the press portion, a second connecting section connected to the spacer, and at least one first elastic section bridging the first connecting section and second connecting section and containing at least one first stress bend point. The second connection arm has a third connecting section connected to the spacer, a fourth connecting section connected to the frame, and at least one second elastic section bridging the third connecting section and fourth connecting section and containing at least one second stress bend point. The first and second connection arms provide deformation and return force for the press portion during movement towards the command portion.

In one aspect the frame includes a plurality of connecting side frames to form the press zone and a corner at the junction of each pair of the side frames. The second connection arm bridges the spacer and one side frame.

In another aspect the frame includes a plurality of connecting side frames to form the press zone and a corner at the junction of each pair of the side frames. The second connection arm bridges the spacer and the corner.

In yet another aspect the keycap assembly board includes a plurality of keycaps corresponding to the press portions. Each keycap has a depressible press surface and a connection pin connecting to the press portion.

In yet another aspect the thin keyboard structure includes at least one elastic support portion located between the circuit board and frame to aid movement of the keycaps against the circuit board.

In yet another aspect the elastic support portion is sponge.

In yet another aspect the elastic support portion is conductive rubber.

In yet another aspect the elastic support portion is a dome-shaped reed.

In yet another aspect the thin keyboard structure includes a baseboard located beneath the circuit board and a light guide layer located between the circuit board and baseboard.

In yet another aspect the thin keyboard structure includes an optical mask layer located on the frame and having a plurality of light permeable openings corresponding to the command portions and an optical mask portion bonded to the frame.

The invention thus formed can provide many advantages, notably:

1. By incorporating the press portion with the deformation portion or spacer to replace the driven mechanism used in the conventional keyboard, total thickness of the keyboard can be reduced to make the keyboard thinner.

2. Simplified keyboard structure. As the driven mechanism in the conventional keyboard is mounted on a baseboard, a lot of related assembly structure is needed. The thinner keyboard of the invention does not need the driven mechanism, thus can omit assembly of the baseboard. As a result, the thin keyboard of the invention can be constructed simpler.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
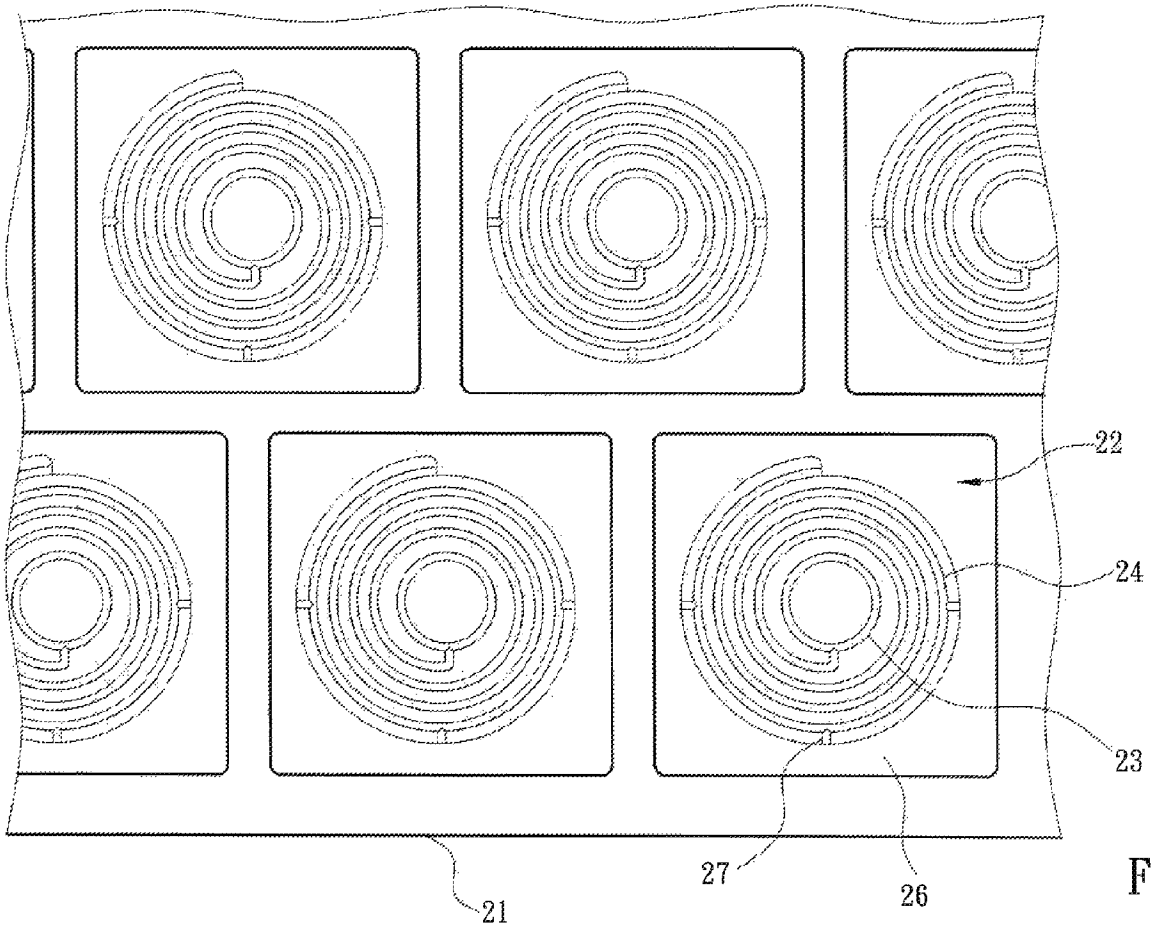
FIG. 1 is a top view of the keycap assembly board of a first embodiment of the invention.
Figure 2:
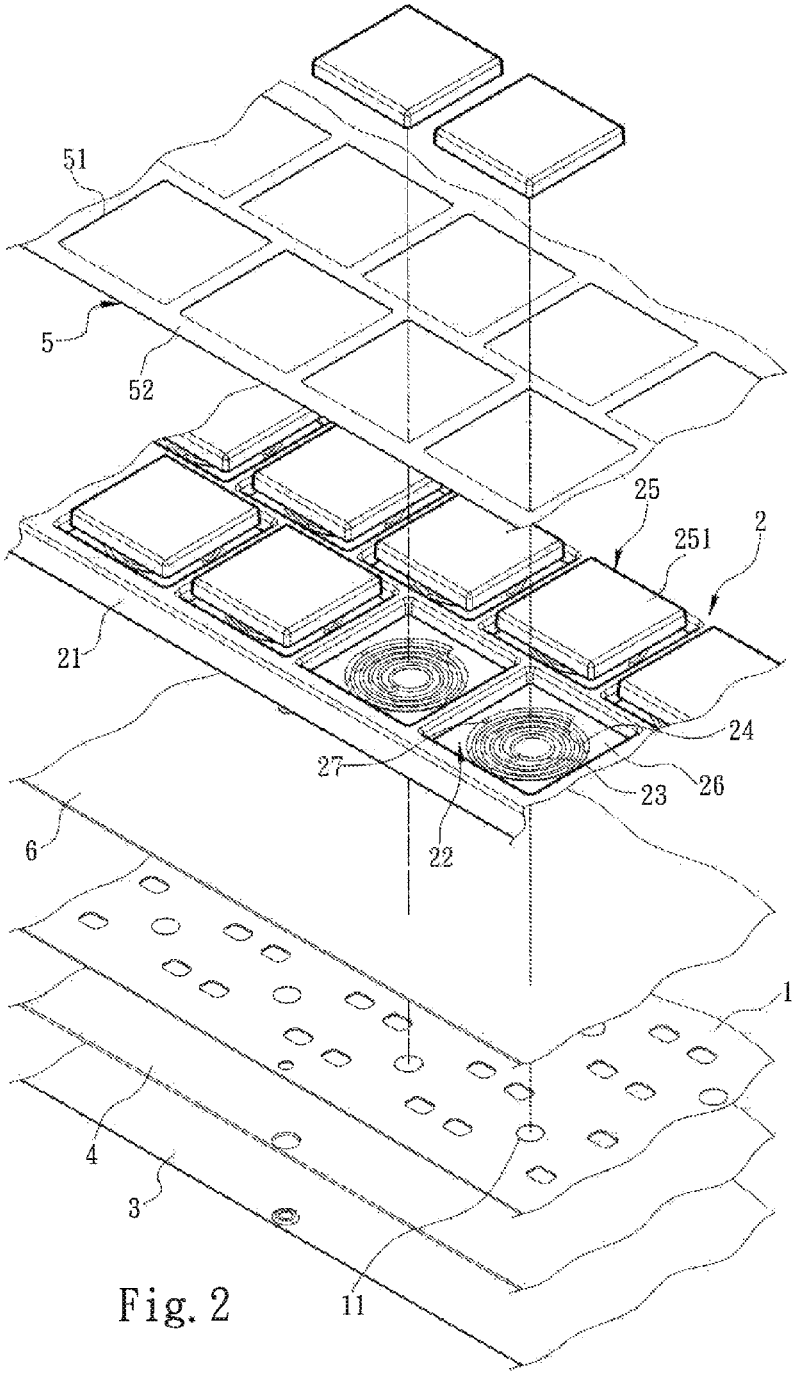
FIG. 2 is an exploded view of the first embodiment of the invention.
Figure 3:
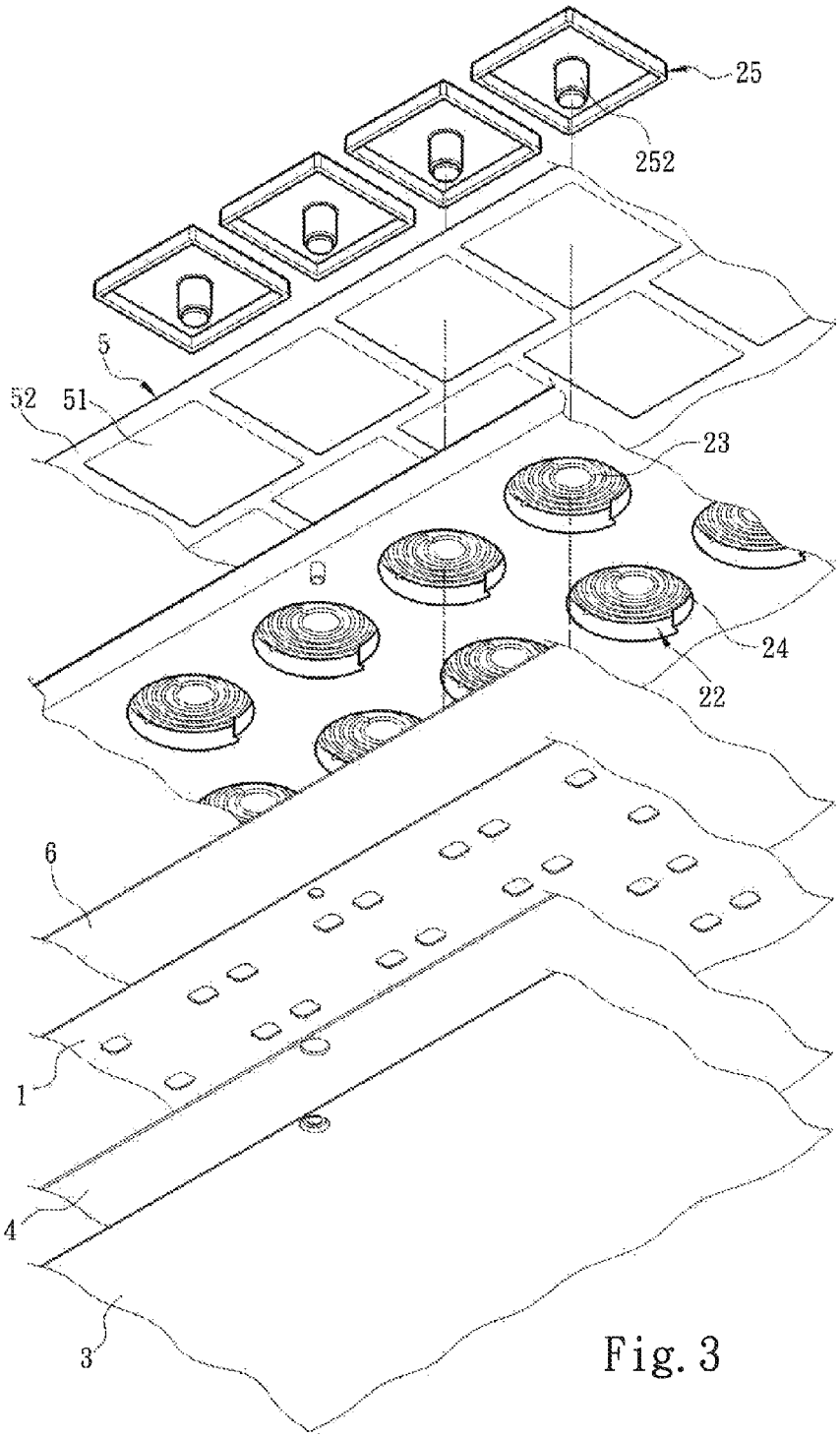
FIG. 3 is another exploded vie of the first embodiment of the invention.

Please refer to FIGS. 1, 2 and 3 for a first embodiment of the invention. The thin keyboard structure of the invention includes a circuit board 1 which has a plurality of command portions 11 to receive contact and generate command signals, a keycap assembly board 2 located on the circuit board 1, a baseboard 3 located beneath the circuit board 1, and a light guide layer 4 located between the circuit board 1 and baseboard 3 to transmit light to the keycap assembly board 2. Furthermore, the keycap assembly board 2 includes a frame 21, a plurality of press zones 22 defined via the frame 21 corresponding to the command portions 11, at least one press portion 23 in each press zone 22 corresponding to each command portion 11 and depressible to move towards the command portion 11, and a deformation portion 24 located in the press zone 22 and centered on the press portion 23 and coiled and extended continuously from the press portion 23 towards the frame 21 at a preset interval to provide deformation and return force for the press portion 23 during movement towards the command portion 11. More specifically, the press portion 23 and deformation portion 24 are formed in a helical fashion. The thin keyboard structure further has an optical mask layer 5 on the frame 21. The optical mask layer 5 has a plurality of light permeable openings 51 corresponding to the command portions 11 and an optical mask portion 52 bonded to the frame 21. The optical mask portion 52 masks light transmitted from the light guide layer 4 to allow light emission through the light permeable openings 51.

Figure 4:
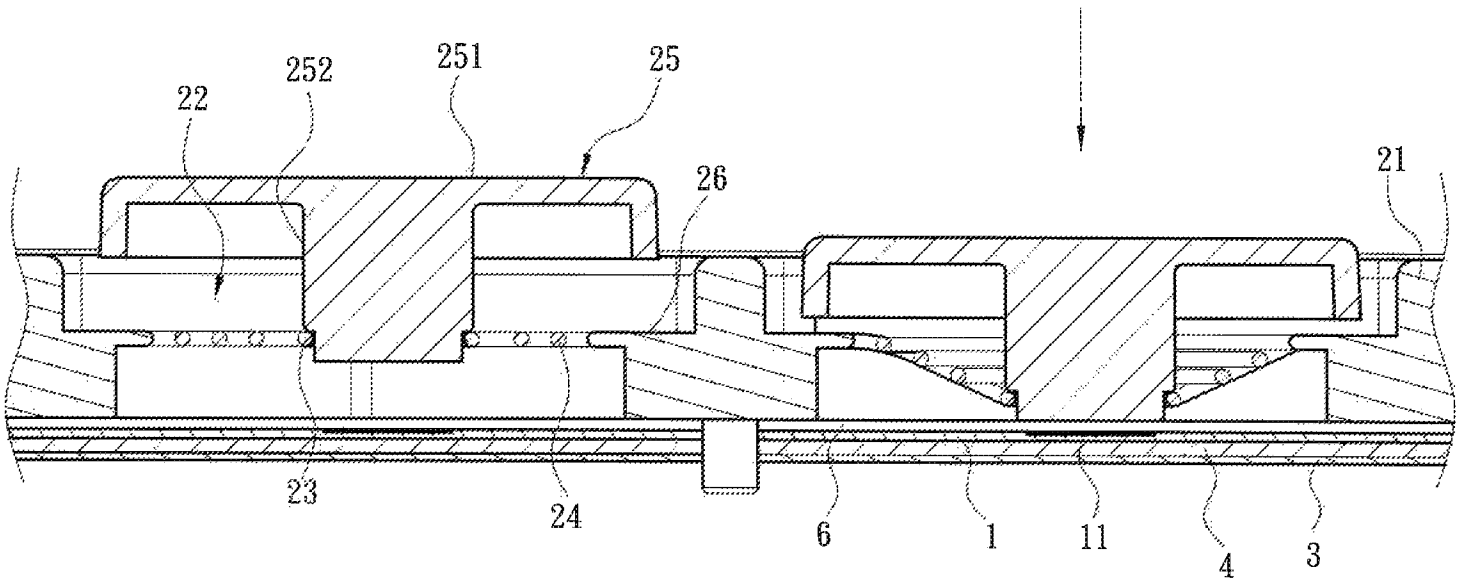
FIG. 4 is a schematic view of the first embodiment of the invention in a press condition.
Figure 5:
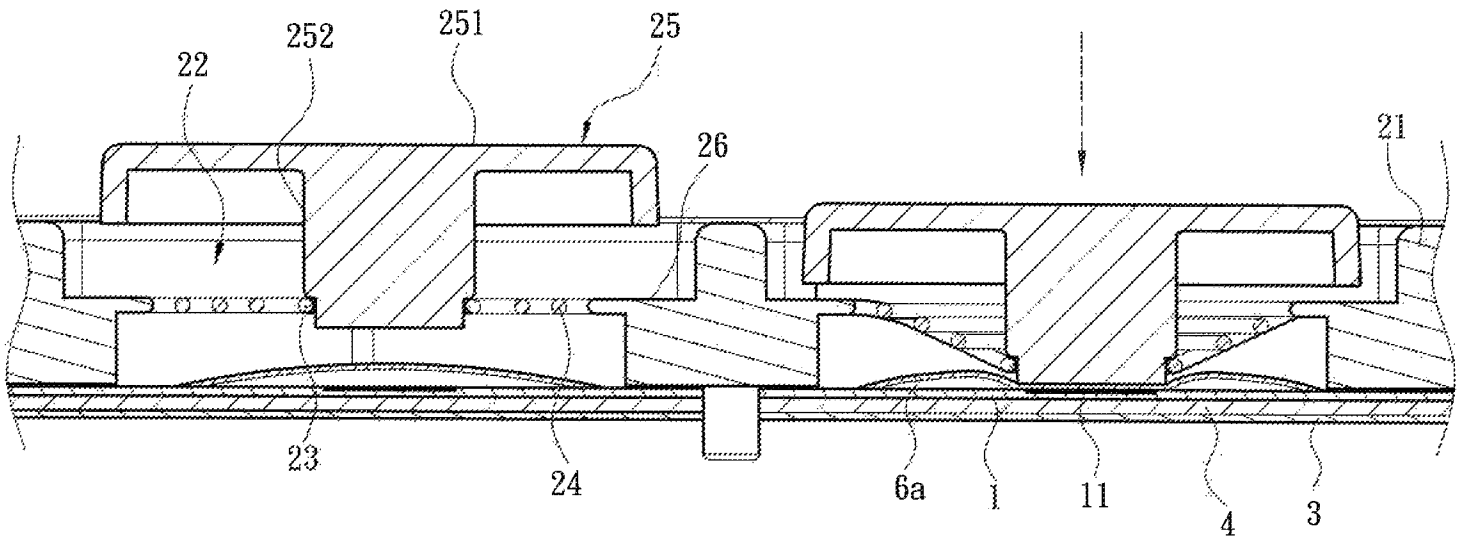
FIG. 5 is a schematic view of a second embodiment of the invention in a press condition.

Please refer to FIGS. 4 and 5, the thin keyboard structure also has at least one elastic support portion 6 located between the circuit board 1 and frame 21 to aid movement of the press portions 23 against the circuit board 1. The keycap assembly board 2 also has a plurality of keycaps 25 corresponding to the press portions 23, a support surface 26 extended from the frame 21 towards the press zone 22 to connect to the deformation portion 24, and at least one support arm 27 to bridge the support surface 26 and deformation portion 24. Each keycap 25 has a depressible press surface 251 and a connection pin 252 connected to the press portion 23. When the press surface 251 is pressed by a force the connection pin 252 is driven to push the press portion 23 and deformation portion 24 towards the circuit board 1 to generate deformation. The connection pin 252 compresses the elastic support portion 6 to set on the command portion 11 to generate a command signal. The elastic support portion 6 can be conductive rubber or sponge interposed between the circuit board 1 and frame 21 (referring to FIG. 4), or a dome-shaped reed 6*a* (referring to FIG. 5) corresponding to the command portion 11. When the force is absent from the keycap 25, the deformation portion 24 and support arm 27 connected to the support surface 26 provide return force for the press portion 23 to return to the original location prior to depression.

Figure 6:
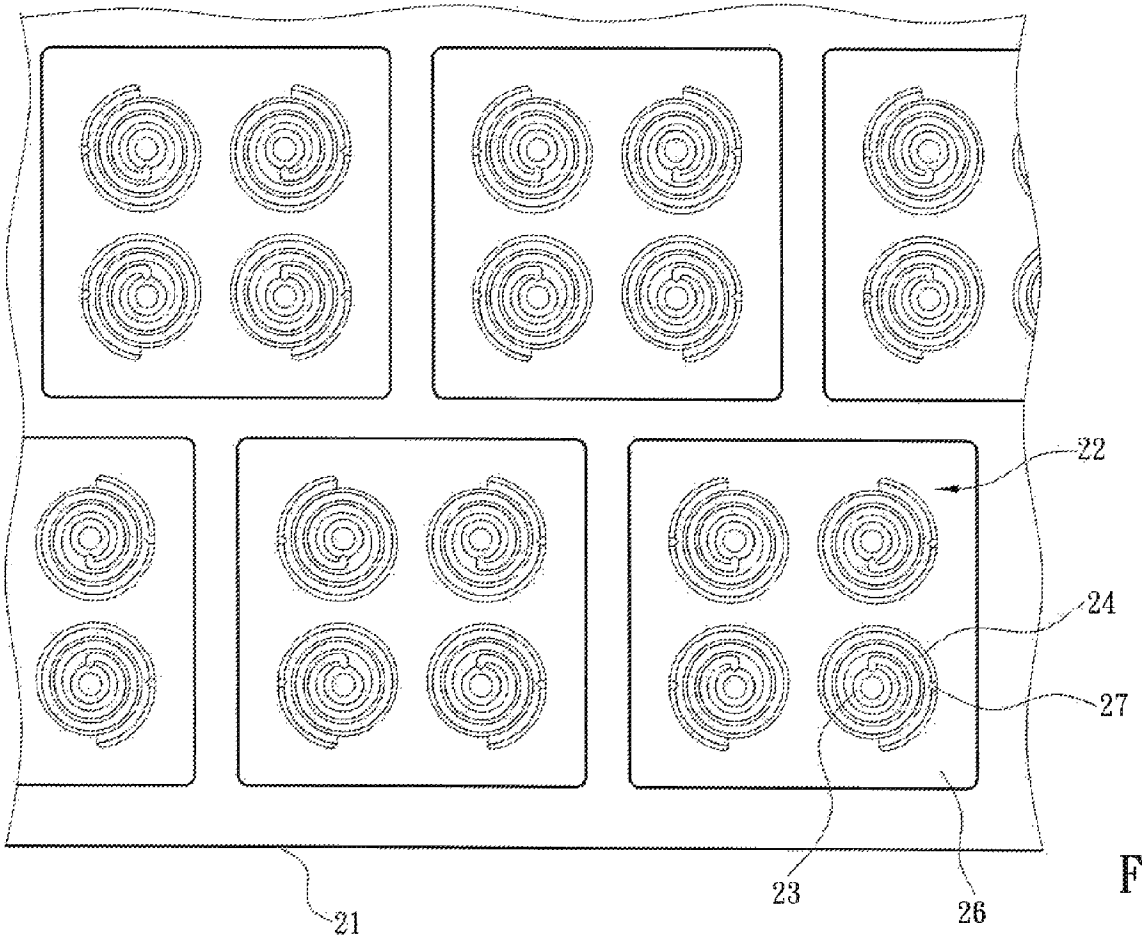
FIG. 6 is a top view of the keycap assembly board of a third embodiment of the invention.

Please refer to FIG. 6, each press zone 22 can include multiple press portions 23 and multiple deformation portions 24 corresponding to the press zones 23. Thereby the keycap assembly board 2 is reinforced to withstand the depressing force received by each keycap 25.

Figure 7:
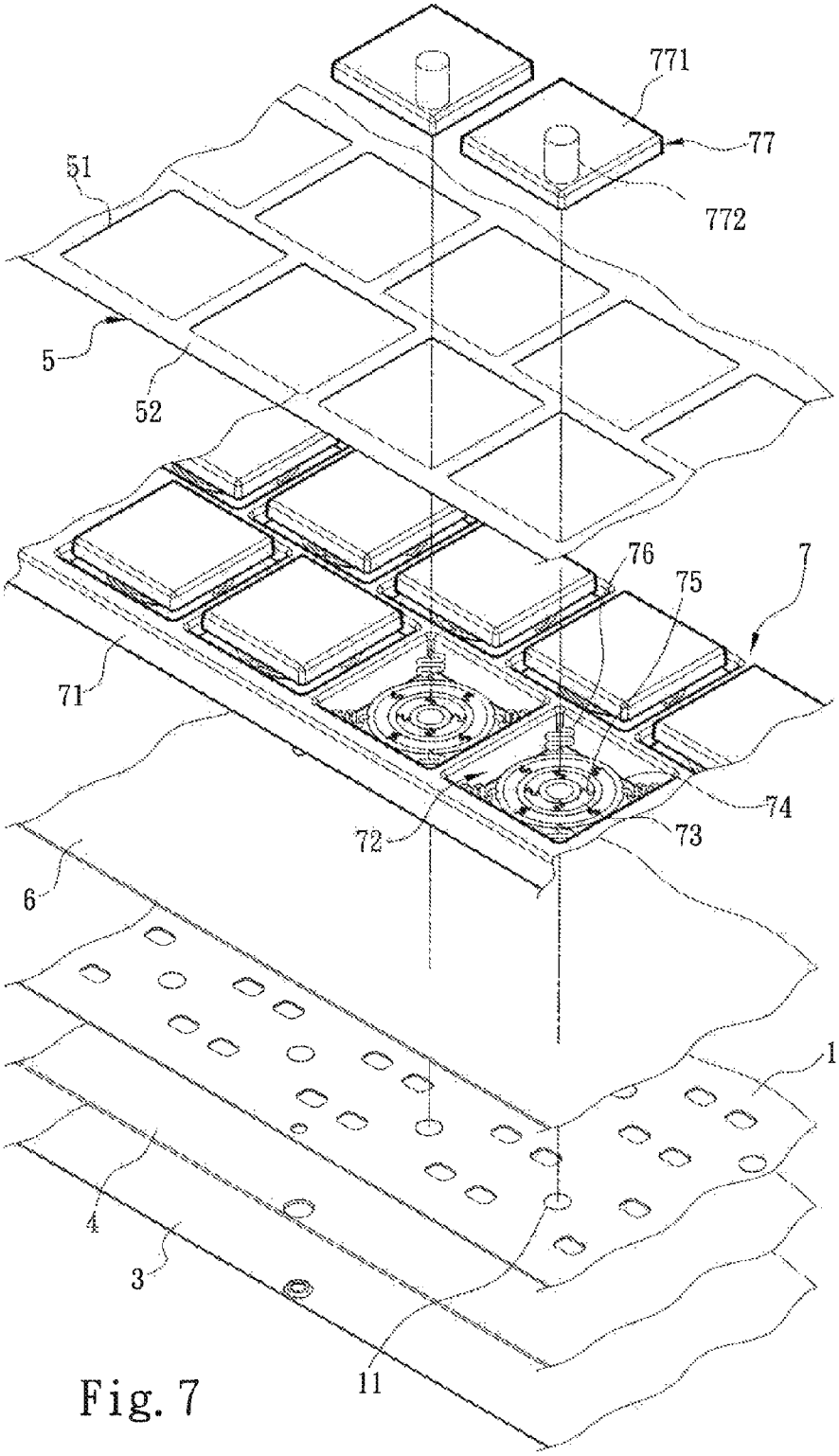
FIG. 7 is an exploded view of a fourth embodiment the invention.
Figure 8:
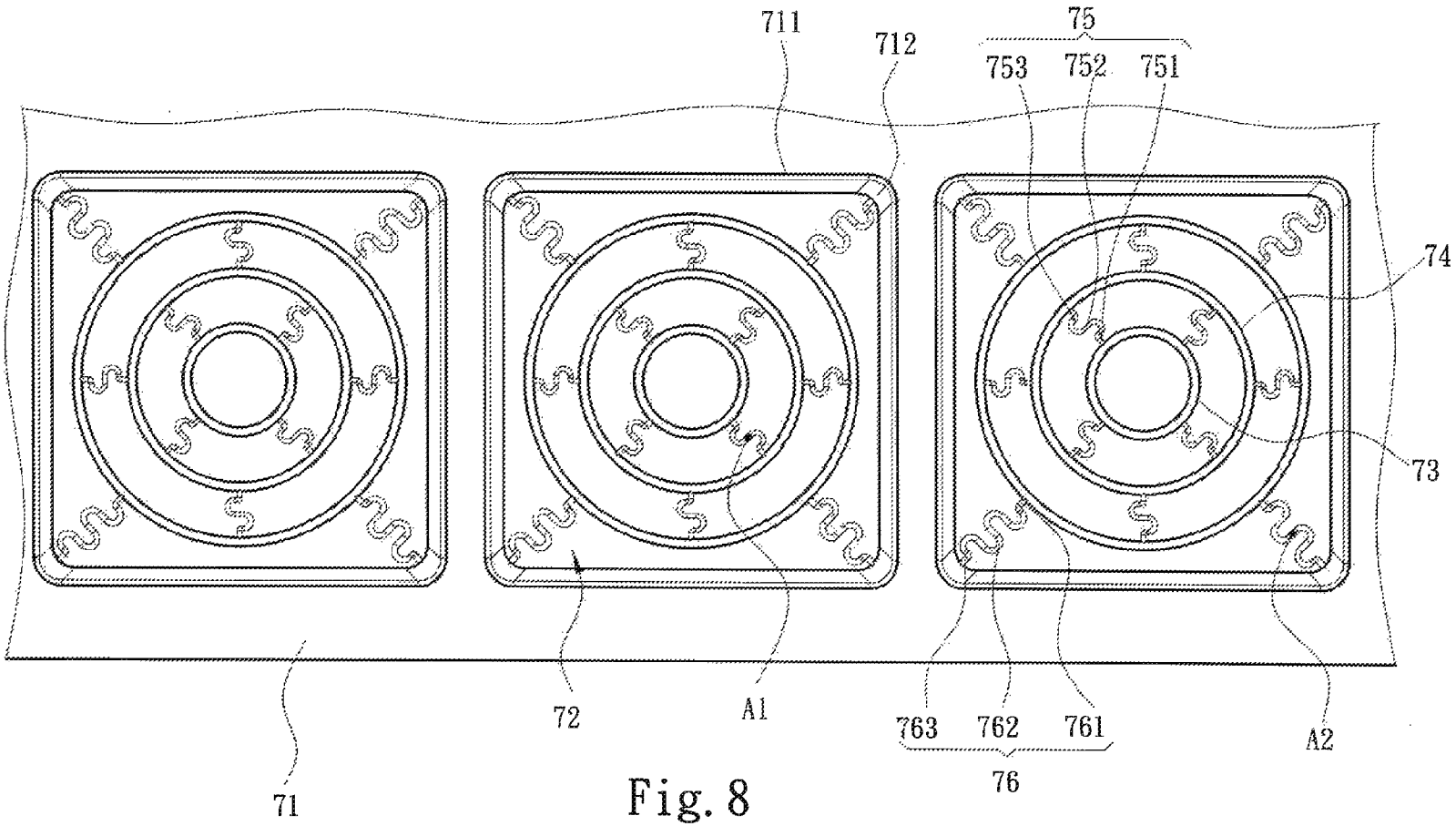
FIG. 8 is a top view of the keycap assembly board of the fourth embodiment of the invention.
Figure 9:
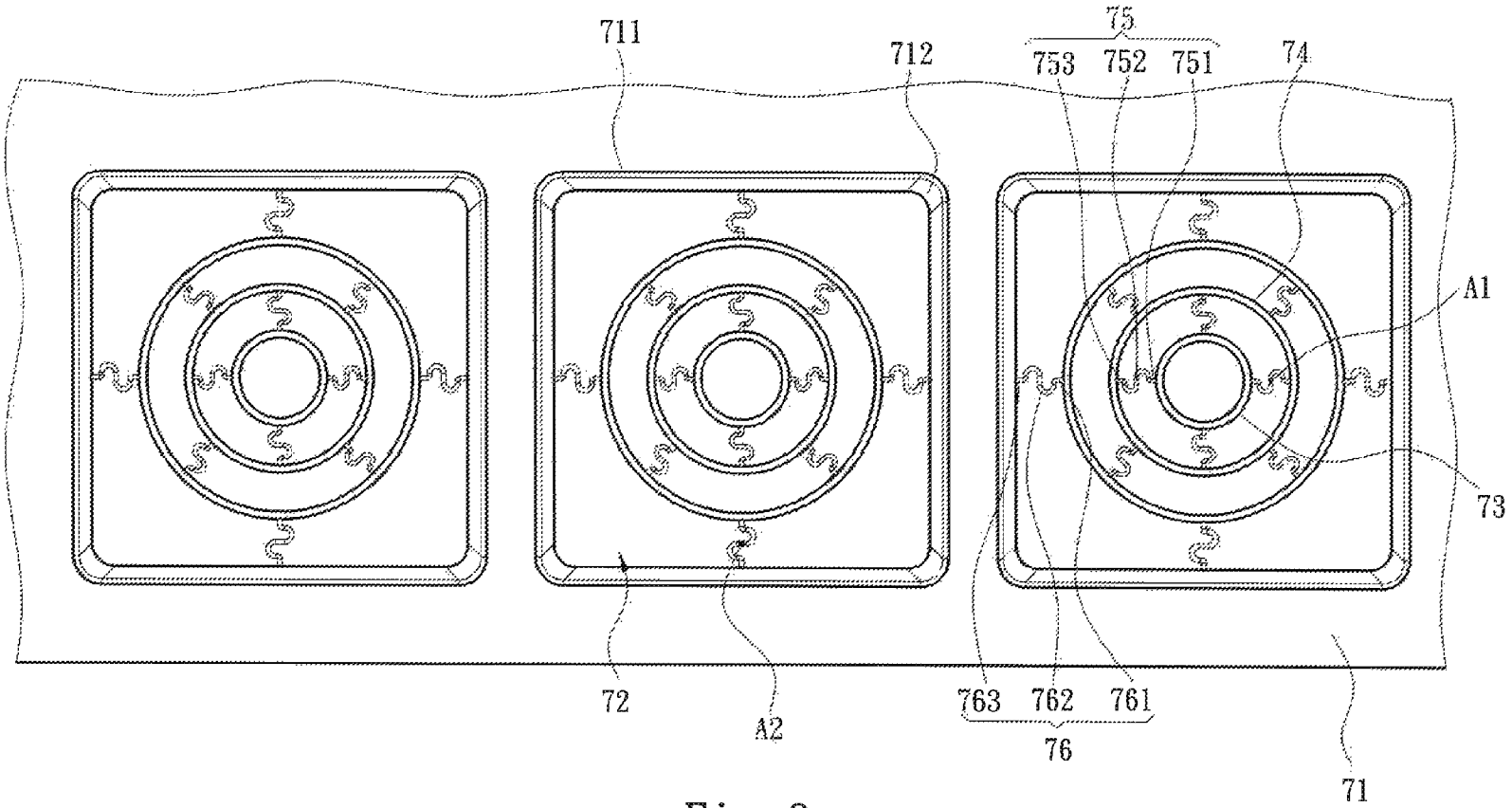
FIG. 9 is a top view of the keycap assembly board of a fifth embodiment of the invention.

Please refer to FIGS. 7, 8 and 9 for another embodiment of the keycap assembly board 7 of the invention. In this embodiment, the keycap assembly board 7 includes a frame 71 located on the circuit board 1 and a plurality of press zones 72 defined via the frame 71 corresponding to the command portions 11. In each press zone 72, at least one press portion 73 is provided corresponding to each command portion 11 and depressible to move towards the command portion 11, and a spacer 74 is also provided and centered about the press portion 73 and spaced from the frame 71 at a present interval. The press portion 73 and spacer 74 are bridged by at least one first connection arm 75, and the spacer 74 and frame 71 are bridged by at least one second connection arm 76. The first and second connection arms 75 and 76 provide deformation and return force for the press portion 73 during movement towards the command portion 11. The first connection arm 75 has a first connecting section 751 connected to the press portion 73, a second connecting section 753 connected to the spacer 74, and at least one first elastic section 752 which bridges the first connecting section 751 and second connecting section 753 and contains at least one first stress bend point A1. Each second connection arm 76 has a third connecting section 761 connected to the spacer 74, a fourth connecting section 763 connected to the frame 71, and at least one second elastic section 762 which bridges the third and fourth connecting sections 761 and 763 and contains at least one second stress bend point A2.

Moreover, the frame 71 further includes a plurality of connecting side frames 711 to form the press zone 72 and a corner 712 at the junction of each pair of the side frames 711. The second connection arm 76 bridges the spacer 74 and one side frame 711, or bridges the spacer 74 and the corner 712. The press portion 73 and spacer 74 are formed in concentric circles. In addition, the keycap assembly board 7 includes a plurality of keycaps 77 corresponding to the press portions 73. Each keycap 77 has a depressible press surface 771 and a connection pin 772 connected to each press portion 73. When the press surface 771 is pressed the connection pin 772 is driven to push the press portion 73 and spacer 74 so that the first and second connection arms 75 and 76 generate deformation towards the circuit board 1, and the connection pin 772 also pushes the elastic support portion 6 to set on the command portion 11 to generate a command signal. Meanwhile, the first elastic section 752 of the first connection arm 75 and the second elastic section 762 of the second connection arm 76 offset the stress generated by the depressed press portion 73 through the first and second stress bend points A1 and A2. Similarly, each press zone 72 can include a plurality of press portions 73 and a plurality of spacers 74 corresponding to the press portions 73.

As a conclusion, the invention provides helical press portion and deformation portion that incorporate with the support arm to replace the driven mechanism used in the conventional keyboard, or concentric and spaced press portion and spacer that incorporate with the first and second connection arms to replace the driven mechanism used in the conventional keyboard. Compared with the conventional keyboards, the keyboard provided by the invention is not constrained by the height of the driven mechanism, thus can be made thinner, smaller and lighter to conform to the prevailing trend of the keyboards pursued by the consumers. In short, the present invention provides significant improvements over the conventional techniques.

What is claimed is:

1. A thin keyboard structure, comprising:

a circuit board including a plurality of command portions to receive contact and generate command signals; and a keycap assembly board which is located on the circuit board and includes a frame with a plurality of press zones corresponding to the plurality of command portions, each of the plurality of press zones including at least one press portion corresponding to one command portion and depressible to move towards the command portion, each press zone also including a deformation portion centered on the press portion and coiled and extended continuously from the press portion towards the frame at a preset interval to provide deformation and return force for the press portion during movement towards the command portion.

2. The thin keyboard structure of claim 1, wherein the keycap assembly board includes a plurality of keycaps corresponding to the press portions, each of the plurality of keycaps including a depressible press surface and a connection pin connecting to the press portion.

3. The thin keyboard structure of claim 2, further including at least one elastic support portion located between the circuit board and the frame to aid movement of the keycaps against the circuit board.

4. The thin keyboard structure of claim 3, wherein the elastic support portion is sponge.

5. The thin keyboard structure of claim 3, wherein the elastic support portion is conductive rubber.

6. The thin keyboard structure of claim 3, wherein the elastic support portion is a dome-shaped reed.

7. The thin keyboard structure of claim 1, further including a baseboard located beneath the circuit board and a light guide layer located between the circuit board and the baseboard.

8. The thin keyboard structure of claim 1, further including an optical mask layer located on the frame, the optical mask layer including a plurality of light permeable openings corresponding to the command portions and an optical mask portion bonded to the frame.

9. The thin keyboard structure of claim 1, wherein the keycap assembly board includes a support surface extended from the frame towards the press zone to connect to the deformation portion and at least one support arm to bridge the support surface and the deformation portion.

10. A thin keyboard structure, comprising:

a circuit board including a plurality of command portions to receive contact and generate command signals; and a keycap assembly board which is located on the circuit hoard and includes a frame with a plurality of press zones corresponding to the plurality of command portions, each of the plurality of press zones including at least one press portion corresponding to one command portion and depressible to move towards the command portion, and at least one spacer centered about the press portion and spaced from the frame at a preset interval, the press portion and the spacer being bridged by at least one first connection arm, the spacer and the frame being bridged by at least one second connection arm; the first connection arm including a first connecting section connected to the press portion, a second connecting section connected to the spacer, and at least one first elastic section which bridges the first connecting section and the second connecting section and includes at least one first stress bend point; the second connection arm including a third connecting section connected to the spacer, a fourth connecting section connected to the frame, and at least one second elastic section which bridges the third connecting section and the fourth connecting section and includes at least one second stress bend point; the first connection arm and the second connection arm providing deformation and return force for the press portion during movement towards the command portion.

11. The thin keyboard structure of claim 10, wherein the frame includes a plurality of connecting side frames to form the press zone and a corner at the junction of each pair of the side frames, the second connection arm bridging the spacer and one side frame.

12. The thin keyboard structure of claim 10, wherein the frame includes a plurality of connecting side frames to form the press zone and a corner at the junction of each pair of the side frames, the second connection arm bridging the spacer and the corner.

13. The thin keyboard structure of claim 10, wherein the keycap assembly board includes a plurality of keycaps corresponding to the press portions, each of the plurality of keycaps including a depressible press surface and a connection pin connecting to the press portion.

14. The thin keyboard structure of claim 11, further including at least one elastic support portion located between the circuit board and the frame to aid movement of the keycaps against the circuit board.

15. The thin keyboard structure of claim 14, wherein the elastic support portion is sponge.

16. The thin keyboard structure of claim 14, wherein the elastic support portion is conductive rubber.

17. The thin keyboard structure of claim 14, wherein the elastic support portion is a dome-shaped reed.

18. The thin keyboard structure of claim 10, further including a baseboard located beneath the circuit board and a light guide layer located between the circuit board and the baseboard.

19. The thin keyboard structure of claim 10, further including an optical mask layer located on the frame, the optical mask layer including a plurality of light permeable openings corresponding to the command portions and an optical mask portion bonded to the frame.

* * * * *